US007905680B2

(12) United States Patent
Albritton et al.

(10) Patent No.: US 7,905,680 B2
(45) Date of Patent: Mar. 15, 2011

(54) CONCRETE DOWEL PLACEMENT DEVICE AND METHODS OF USE

(76) Inventors: Steve Albritton, Sugarland, TX (US); Earl Remmert, Cypress, TX (US); Ming Liang, Missouri City, TX (US)

( * ) Notice: Subject to any disclaimer, the term of this patent is extended or adjusted under 35 U.S.C. 154(b) by 602 days.

(21) Appl. No.: 11/899,327

(22) Filed: Sep. 5, 2007

(65) Prior Publication Data

US 2009/0060657 A1 Mar. 5, 2009

(51) Int. Cl.
*E01C 11/14* (2006.01)

(52) U.S. Cl. ..... 404/48; 404/56; 404/62; 404/65

(58) Field of Classification Search ..... 404/48, 404/50, 51, 52, 56, 62, 63, 64, 65; 52/677
See application file for complete search history.

(56) References Cited

U.S. PATENT DOCUMENTS

| | | | | |
|---|---|---|---|---|
| 5,005,331 | A * | 4/1991 | Shaw et al. | 52/396.02 |
| 5,487,249 | A * | 1/1996 | Shaw et al. | 52/396.02 |
| 5,618,125 | A * | 4/1997 | McPhee et al. | 403/12 |
| 5,678,952 | A * | 10/1997 | Shaw et al. | 404/62 |
| 5,934,821 | A | 8/1999 | Shaw | |
| 6,502,359 | B1 * | 1/2003 | Rambo | 52/396.04 |
| 6,926,463 | B2 | 8/2005 | Shaw | |
| 7,314,334 | B1 * | 1/2008 | Bennett et al. | 404/63 |
| 7,404,691 | B2 * | 7/2008 | Bennett et al. | 404/134 |
| 7,441,985 | B2 * | 10/2008 | Kelly et al. | 404/56 |

* cited by examiner

*Primary Examiner* — Gary S Hartmann
(74) *Attorney, Agent, or Firm* — Lapus Greiner Lai Corsini, LLC; Jason Wu; Theodore Lapus

(57) ABSTRACT

Provided herein are a concrete dowel placement device and methods of use. The device 100 generally comprises a dowel receiving sleeve 110, a flange 120 formed to extend perpendicularly and completely about an open end b of the dowel receiving sleeve and at least one tooth-like locking structure 140*a,b* integrally formed on the outer surface 111 of the sleeve and proximate to the flange. The combination of the flange and the tooth-like locking structure secures the deviced to a concrete form so that a dowel rod 150 or piece of rebar placed therein maintains its position during a concrete pour.

23 Claims, 2 Drawing Sheets

CONCRETE DOWEL PLACEMENT DEVICE AND METHODS OF USE

BACKGROUND OF THE INVENTION

1. Field of the Invention

The present invention relates to the field of concrete construction. Specifically, the present invention relates to a concrete dowel placement device that holds itself in position for concrete construction applications.

2. Description of the Related Art

The efficient placing of concrete dowel placement devices in a time and cost effective manner while maintaining the proper position of the dowels placed therein during a concrete pour is an ongoing concern in concrete construction. In solving this problem, for example, U.S. Pat. No. 5,005,331 discloses slip and non-slip concrete dowel placement devices. The device has sleeves with a hollow tubular sheath and a perpendicular flange formed at the opening to facilitate attachment of the sheath to a concrete form via conventional means, such as nails or screws.

U.S. Pat. No. 5,678,952 discloses a concrete dowel placement apparatus that comprises interconnectable components. The apparatus has a base member and an elongate tubular dowel receiving sheath. The base member comprises an outer sleeve and an inner sleeve attached to a flange which accommodates a nail for attachment to a concrete form. The receiving sheath slides over the outer sleeve. In a related apparatus, U.S. Pat. No. 5,934,821 discloses a concrete dowel placement apparatus as in U.S. Pat. No. 5,678,952 with the addition of at least one reinforcement wall between the outer and inner sleeves of the base member.

Alternatively, systems that don't require dowel rods have been used. U.S. Pat. No. 6,926,463 discloses a disk plate concrete dowel system. The system uses a positioner bracket which is attachable at a flange to a concrete form by standard fasteners, a pocket former which extends from the bracket base and a dowel plate which slides into the pocket former after the concrete form and the base flange are removed after a concrete pour. The disk plate system is interposed between adjacent concrete pours and defines a pour joint.

However, problems still exist with the prior art devices. The prior art devices require that a plurality of fasteners be used to attach them to the concrete forms. Also, some devices require assembly of component parts. In addition, some devices must be removed from a concrete pour. This requires additional materials and labor which increases fabrication time and costs.

A recognized need is present in the art for a concrete dowel placement device that facilitates its own placement and that of a concrete dowel in a concrete structure. More specifically, the prior art is deficient in a concrete dowel placement device that has an integral locking structure formed thereon which secures the device to a concrete form. The present invention fulfills this long-standing need and desire in the art.

SUMMARY OF THE INVENTION

The present invention is directed to a concrete dowel placement device. The device comprises a dowel receiving sleeve having a substantially cylindrical body with an outer surface, an open proximal end, a distal end, and an inner hollow compartment extending longitudinally therethrough, a flange formed to extend perpendicularly and completely about the open end of the dowel receiving sleeve and at least one tooth-like locking structure integrally formed on the outer surface of the sleeve proximate to the inner flange surface. A related device may further comprise a stop on the receiving sleeve proximate to the distal end and extending a distance into the inner hollow compartment. Another related device may further comprise one or more gussets formed longitudinally along the outer surface of the receiving sleeve and in supporting contact with an inner surface of the flange.

The present invention also is directed to a related concrete dowel placement device. The device comprises a dowel receiving sleeve having a substantially cylindrical body with an outer surface, an open proximal end, a distal end, and an inner hollow compartment extending longitudinally therethrough and a stop on the receiving sleeve proximate to the distal end and extending a distance into the inner hollow compartment. The device also comprises a flange formed to extend perpendicularly and completely about the open end of the dowel receiving sleeve, said flange having substantially flat outer surface and inner surfaces. The device further comprises at least one reverse tooth integrally formed from the outer surface of the sleeve proximate to the inner flange surface where the reverse tooth has a distal end projecting angularly from the outer sleeve surface toward the inner flange surface and a proximal end formed on the outer surface of the sleeve. A related device may further comprise one or more gussets formed longitudinally along the outer surface of the receiving sleeve and in supporting contact with the inner surface of the flange.

The present invention is directed further to a method for securing a dowel placement device to a concrete form. The method comprises providing a wooden concrete form having a plurality of holes along a length thereof and inserting the dowel placement device described through each of the holes. The inner surface of the flange abuts an outer surface of the wooden form and the tooth-like locking structure(s) abuts an inner surface of the wooden form to lock the device against the wooden form thereby securing the device thereto. The present invention is directed to a related method comprising the further step of positioning a dowel rod or piece of rebar within the receiving sleeve of each device. The present invention is directed to a further related method comprising the step of pouring concrete within the concrete form.

Other and further aspects, features and advantages of the present invention will be apparent from the following description of the presently preferred embodiments of the invention given for the purpose of disclosure.

BRIEF DESCRIPTION OF THE DRAWINGS

So that the matter in which the above-recited features, advantages and objects of the invention, as well as others which will become clear, are attained and can be understood in detail, more particular descriptions and certain embodiments of the invention briefly summarized above are illustrated in the appended drawings. These drawings form a part of the specification. It is to be noted, however, that the appended drawings illustrate preferred embodiments of the invention and therefore are not to be considered limiting in their scope.

DETAILED DESCRIPTION OF THE INVENTION

Figure 1A:
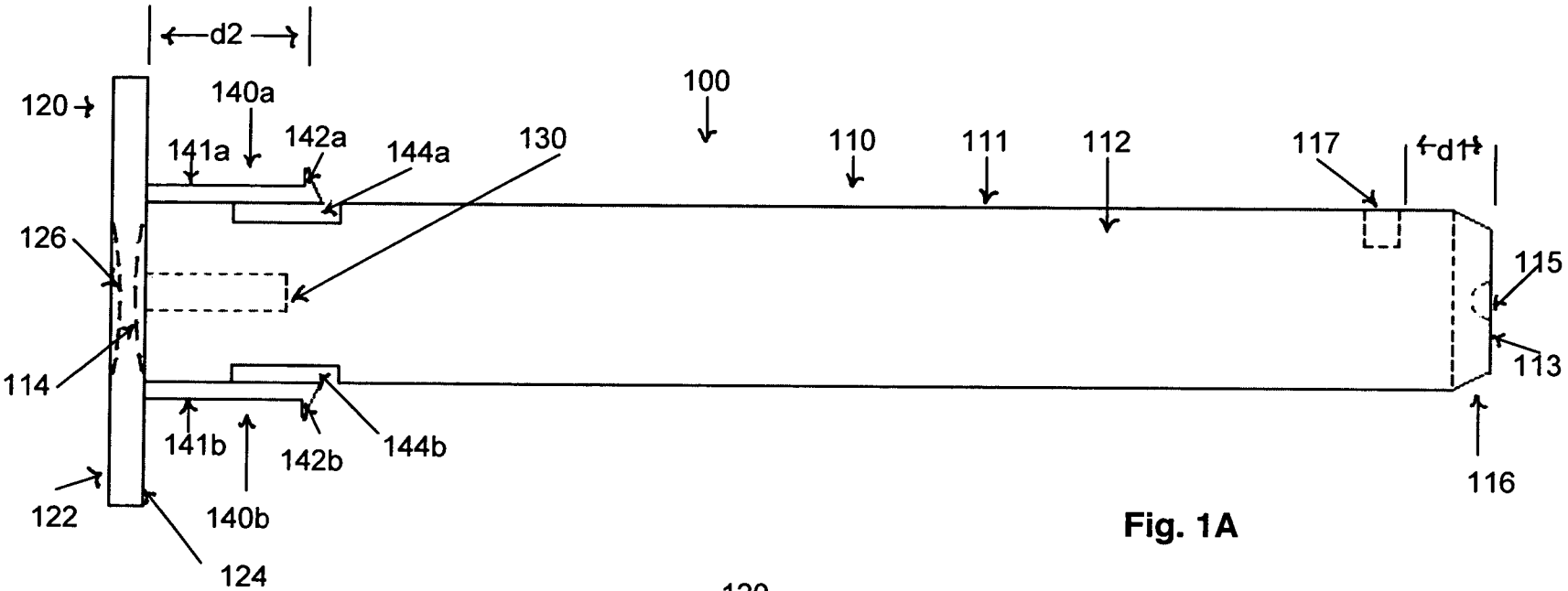
FIG. 1A depicts a cross-sectional view of the concrete dowel placement device.

As used herein, the term "a" or "an", when used in conjunction with the term "comprising" in the claims and/or the specification, may refer to "one", but it is also consistent with the meaning of "one or more", "at least one", and "one or more than one". Some embodiments of the invention may consist of or consist essentially of one or more elements, method steps, and/or methods of the invention. It is contemplated that any device or method described herein can be implemented with respect to any other device or method described herein.

As used herein, the term "or" in the claims refers to "and/or" unless explicitly indicated to refer to alternatives only or the alternatives are mutually exclusive, although the disclosure supports a definition that refers to only alternatives and "and/or".

In one embodiment of the present invention there is provided a concrete dowel placement device, comprising a dowel receiving sleeve having a substantially cylindrical body with an outer surface, an open proximal end, a distal end, and an inner hollow compartment extending longitudinally therethrough; a flange formed to extend perpendicularly and completely about the open end of the dowel receiving sleeve; and at least one tooth-like locking structure integrally formed on the outer surface of the sleeve proximate to the inner flange surface. In a further embodiment the device may comprise a stop on the receiving sleeve proximate to the distal end and extending a distance into the inner hollow compartment. In another further embodiment the device may comprise one or more gussets formed longitudinally along the outer surface of the receiving sleeve and in supporting contact with an inner surface of the flange.

In this embodiment, the device may be formed from molded plastic, wood or metal. Also, the receiving sleeve distal end may be tapered to a substantially flat surface having an opening therethrough. In addition, the interior hollow compartment may have a size and configuration permitting a dowel rod or piece of rebar to be slidably inserted longitudinally through a central aperture comprising the flange into the receiving sleeve. Furthermore, the flange may have substantially flat outer and inner surfaces, said inner surface of the flange held in abutting contact with a flat outer surface of a concrete form. The flange may be of a substantially circular shape or of a substantially hexagonal shape. Further to this embodiment, the device may comprise one or more gussets formed longitudinally along the outer surface of the receiving sleeve and in supporting contact with an inner surface of the flange.

Also, in this embodiment the locking structure is a reverse tooth integrally formed from the outer surface of the sleeve proximate to the inner flange surface where the reverse tooth may have a distal end projecting angularly from the outer sleeve surface toward the inner flange surface and a proximal end formed on the outer sleeve surface. In addition, a distance between the inner surface of the flange and the proximal end of the reverse tooth may be about equal to a thickness of a concrete form against which the inner surface of the flange abuts. In this embodiment the concrete form may be wood.

In another embodiment of the present invention, there is provided a concrete dowel placement device, comprising a dowel receiving sleeve having a substantially cylindrical body with an outer surface, an open proximal end, a distal end, and an inner hollow compartment extending longitudinally therethrough; a stop on the receiving sleeve proximate to the distal end and extending a distance into the inner hollow compartment; a flange formed to extend perpendicularly and completely about the open end of the dowel receiving sleeve, said flange having substantially flat outer surface and inner surfaces; and at least one reverse tooth integrally formed from the outer surface of the sleeve proximate to the inner flange surface, said reverse tooth having a distal end projecting angularly from the outer sleeve surface toward the inner flange surface and a proximal end formed on the outer surface of the sleeve.

The dowel receiving sleeve, the flange, the reverse tooth and the materials forming the same are as described supra. Also, the positional relationship of the device components to a concrete form are as described supra.

In yet another embodiment of the present invention there is provided a method for securing a dowel placement device to a concrete form, comprising providing a wooden concrete form having a plurality of holes along a length thereof; and inserting the dowel placement device described supra through each of the holes such that the inner surface of the flange abuts an outer surface of the wooden form and the tooth-like locking structure(s) abuts an inner surface of the wooden form to lock the device against the wooden form thereby securing the device thereto.

Further to this embodiment, the method comprises positioning a dowel rod or piece of rebar within the receiving sleeve of each device. Further still, the method comprises pouring concrete within the concrete form. The concrete dowel placement device is as described supra.

Provided herein are devices and methods for properly positioning and maintaining position of a dowel used in a concrete application in a time effective manner. Generally, the concrete dowel placement device comprises a means for receiving and maintaining a dowel in proper position during a concrete pour and means for aligning and retaining the device in an abutting position to a concrete form. The device requires no separate fasteners to hold it in position against the concrete form and remains stably in position after a concrete pour.

Embodiments of the present invention are better illustrated with reference to the Figure(s), however, such reference is not meant to limit the present invention in any fashion. The embodiments and variations described in detail herein are to be interpreted by the appended claims and equivalents thereof.

Figure 1B:
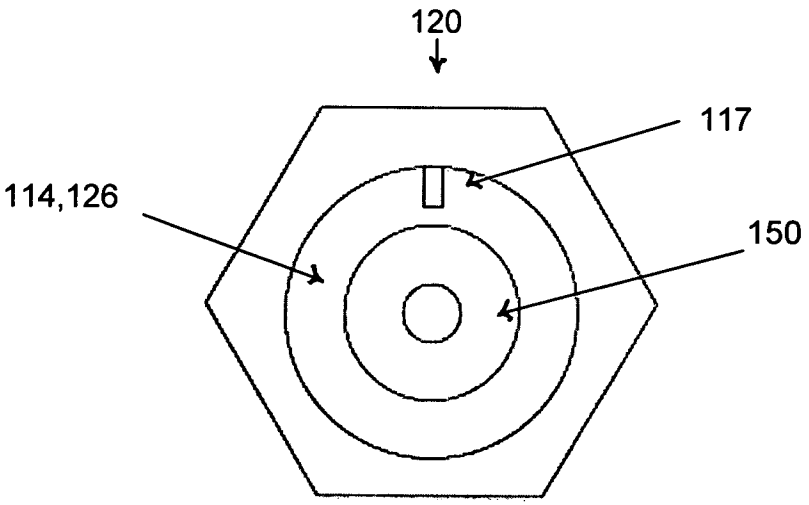
FIG. 1B depicts a end view of the flange of the concrete dowel placement device.

FIG. 1A is a cross-sectional view of the concrete dowel placement device 100. The device comprises a receiving sleeve 110 with a substantially cylindrical interior hollow body 112 comprising an open proximal end 114 and a distal end 116. The outer surface 111 of the receiving sleeve may be tapered at the distal end to a flat surface 113 smaller than the proximal end opening and may have an opening 115 therethrough. The receiving sleeve has a stop 117 near the distal end 116 thereof which extends into the interior hollow body 112 to stop the dowel rod or piece of rebar within the receiving sleeve. The distance d1 from the distal end of the receiving sleeve to the stop may be a minimum of 0.25 inches and represents a gap between the distal end of the receiving sleeve and the stop. The stop allows for maximum theoretical expansion and contraction of the adjoining concrete slabs. Also, the stop also is a safety measure in case the receiving sleeve should be infiltrated by incompressible materials, e.g., aggregate, such as river rock or limestone, depending upon the concrete application. A flange 120 is perpendicularly extended around the proximal open end 114. The flange has an outer surface 122 and inner surface 124 and comprises a central aperture 126 therethrough which matches with the open proximal end of the receiving sleeve such that a dowel rod or piece of rebar 150, as shown in FIG. 1B, may be slid through the central aperture and the open proximal end into and along the length of the receiving sleeve.

Optionally, it is contemplated that the outer surface 111 may have one or more structures or gussets 130 raised or extruded from the outer surface of the receiving sleeve 110 at the proximal end thereof and disposed lengthwise along the outer surface and perpendicular to the flange 120. The one or more gussets may provide additional support at the juncture of the flange and the receiving sleeve 110.

In addition, the receiving sleeve comprises one or more locking structures 140*a*,140*b* formed on the outer surface thereof as an integral structure. The locking structure may comprise a reverse tooth structure with proximal 141*a*,141*b* and distal 142*a*,142*b* ends. The distal end of the reverse tooth projects angularly from the outer surface 111 of the receiving sleeve 110 and points toward the inner flange surface 124. The proximal end 140*a*,140*b* of the reverse tooth integrates with the outer surface of the receiving sleeve.

The distal end 142*a*,142*b* of the reverse tooth is sufficiently angled toward the proximal end so that it is effective to support or lock a concrete form in a position perpendicular to the concrete dowel placement device after inserting it through the concrete form. The reverse tooth component supports and stabilizes the angle juncture therebetween. The distance d2 between the distal end of the locking structure or reverse tooth and the inner flange surface 124 is about equal to the thickness of a concrete form used in a concrete application.

The distal ends 142*a*,142*b* of the locking structures are disposed over indents or indented areas 144*a*,144*b* formed on the outer surface of the receiving sleeve 110. The space provided by these indents allows for compression of the reverse tooth or distal end of the locking structure when the concrete dowel placement device is inserted through a wooden concrete form prior to receiving a dowel rod or piece of rebar therein.

Preferably, the device is formed of molded plastic using well-known and standard techniques. Alternatively, the device may be formed of wood or metal. One of ordinary skill in the art is well able to determine which materials and methods of manufacture would be suitable for the concrete dowel placement device described herein.

With continued reference to FIG. 1A, FIG. 1B is an end view of the concrete dowel placement device depicting an outer surface 122 view of the flange 120 on the proximal end 114 of the dowel receiving sleeve 110. Although depicted with a substantial hexagonal shape, this is not intended as a limiting feature. For example, the flange may be circular in shape. In this view, the central aperture 126 is aligned with the open proximal end 114 of the receiving sleeve 110 showing the stop 117. A dowel rod 150 or piece of rebar is disposed within the receiving sleeve.

Figure 2:
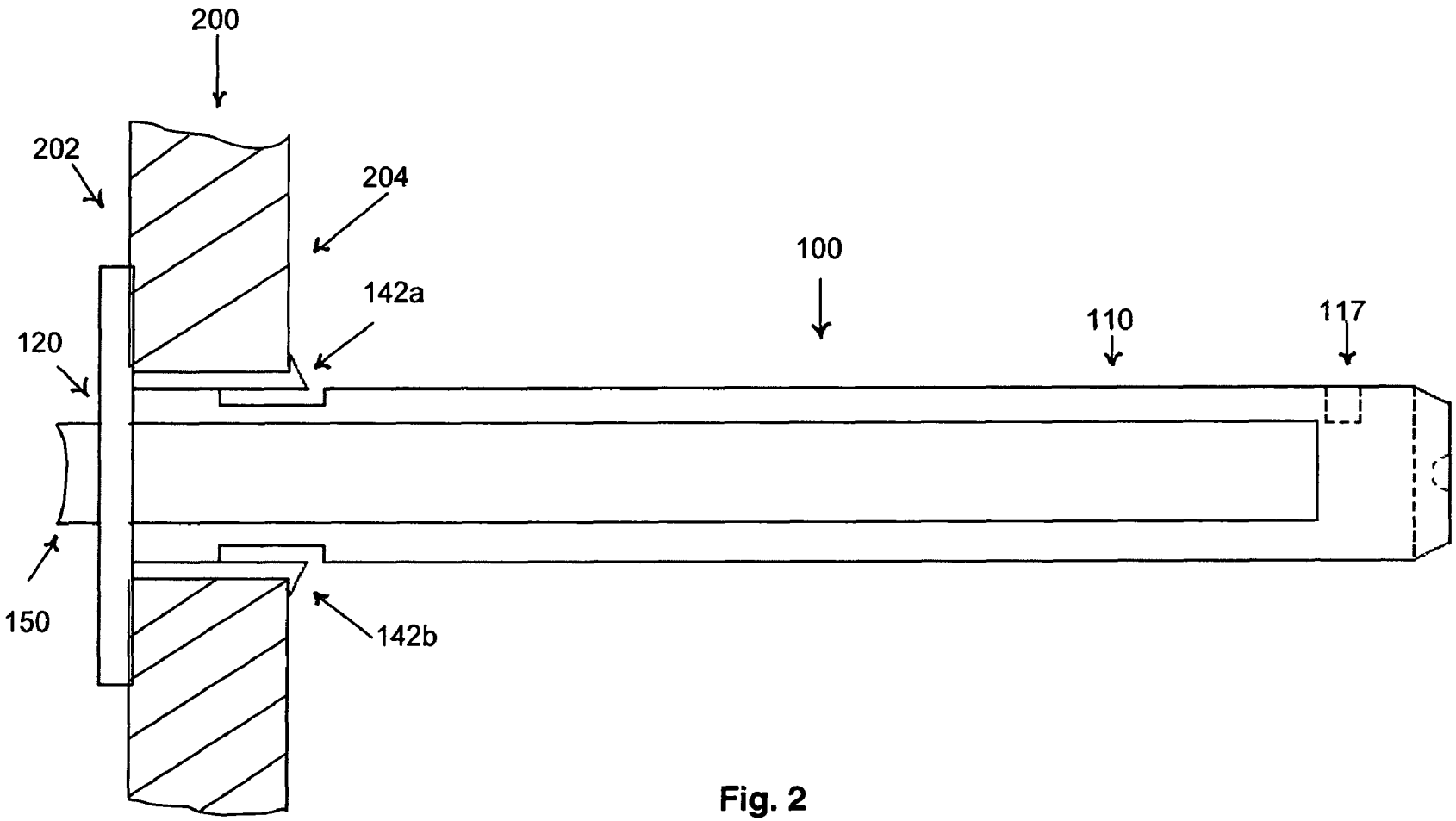
FIG. 2 depicts a cross-sectional side view of the concrete dowel placement device secured to a concrete form.

With continued reference to FIGS. 1A-1B, FIG. 2 depicts a side cross-sectional view of the concrete dowel placement device secured to a wooden concrete form. The wooden form 200 has outer 202 and inner 204 surfaces parallel to the flange 120. A plurality of holes are formed through the form connecting the inner and outer surfaces. The diameter of each is sufficient to accommodate the receiving sleeve 110 of the concrete dowel placement device. The device 100 is pushed through the hole until the inner flange surface 124 abuts the outer surface 202 of the wooden concrete form and the distal end 142*a*,142*b* of the locking structure is in contact with the inner surface 204 of the concrete form. Without being limiting, a standard thickness of a concrete form is about 11/16 in. Concrete forms may be made of wood, such as redwood.

Because the distance between the inner flange surface and the proximal end of the reverse tooth is about equal to the thickness of the form, the receiving sleeve can neither be pushed through nor pulled from the concreted form and is, therefore, held securely in place. Thus, so secured to the concrete form a dowel rod 150 or piece of rebar may be slidably positioned longitudinally through the flange central aperture 126 into the hollow interior body 112 of the receiving sleeve 110. Concrete may then be poured up to the form. Thus, the dowel receiving sleeve holds a dowel, e.g., a smooth dowel rod, in a parallel position to both the centerline of the form and the surface of the pavement. This is effective to prevent uncontrolled cracking, spalling or blowups in the concrete pavement.

One skilled in the art will appreciate that the present invention is well adapted to carry out the objects and obtain the ends and advantages mentioned, as well as those objects, ends and advantages inherent herein. Changes therein and other uses which are encompassed within the spirit of the invention as defined by the scope of the claims will occur to those skilled in the art.

What is claimed is:

1. A concrete dowel placement device, comprising:

a dowel receiving sleeve having a substantially cylindrical body with an outer surface, an open proximal end, a distal end, and an inner hollow compartment extending longitudinally therethrough;

a flange formed to extend perpendicularly and completely about the open end of the dowel receiving sleeve;

at least one tooth-like locking structure integrally formed on the outer surface of the sleeve proximate to the inner flange surface; and an indent formed on the outer surface of the receiving sleeve to provide space for compression of the tooth-like locking structure.

2. The concrete dowel placement device of claim 1, further comprising:

a stop on the receiving sleeve proximate to the distal end and extending a distance into the inner hollow compartment.

3. The concrete dowel placement device of claim 1, further comprising:

one or more gussets formed longitudinally along the outer surface of the receiving sleeve and in supporting contact with an inner surface of the flange.

4. The concrete dowel placement device of claim 1, wherein the receiving sleeve distal end is tapered to a substantially flat surface having an opening therethrough.

5. The concrete dowel placement device of claim 1, wherein the interior hollow compartment has a size and configuration permitting a dowel rod or piece of rebar to be slidably inserted longitudinally through a central aperture comprising the flange into the receiving sleeve.

6. The concrete dowel placement device of claim 1, wherein the flange has substantially flat outer and inner surfaces, said inner surface of the flange held in abutting contact with a substantially flat outer surface of a concrete form.

7. The concrete dowel placement device of claim 6, wherein the flange has a substantially circular shape or a hexagonal shape.

8. The concrete dowel placement device of claim 1, wherein the locking structure is a reverse tooth integrally formed from the outer surface of the sleeve proximate to the inner flange surface, said reverse tooth having a distal end projecting angularly from the outer sleeve surface toward the inner flange surface and a proximal end formed on the outer sleeve surface.

9. The concrete dowel placement device of claim 8, further comprising a concrete form: and wherein the thickness of the concrete form is about equal to a distance between the inner surface of the flange and the distal end of the reverse tooth.

10. The concrete dowel placement device of claim 9, wherein the concrete form is wood.

11. The concrete dowel placement device of claim 1, wherein the device is formed of molded plastic, wood or metal.

12. A method for securing a dowel placement device to a concrete form, comprising:

providing a wooden concrete form having a plurality of holes along a length thereof;

inserting the dowel placement device of claim 1 through each of the holes;

compressing a tooth-like structure into an indent on the outer surface of the receiving sleeve; and such that the inner surface of the flange abuts an outer surface of the wooden form and the tooth-like locking structure(s) abuts an inner surface of the wooden form to lock the device against the wooden form thereby securing the device thereto.

13. The method of claim 12, further comprising:

positioning a dowel rod or piece of rebar within the receiving sleeve of each device.

14. The method of claim 13, further comprising:

pouring concrete within the concrete form.

15. A concrete dowel placement device, comprising:

a dowel receiving sleeve having a substantially cylindrical body with an outer surface, an open proximal end, a distal end, and an inner hollow compartment extending longitudinally therethrough;

a stop on the receiving sleeve proximate to the distal end and extending a distance into the inner hollow compartment;

a flange formed to extend perpendicularly and completely about the open end of the dowel receiving sleeve, said flange having substantially flat outer surface and inner surfaces;

at least one reverse tooth integrally formed from the outer surface of the sleeve proximate to the inner flange surface, said reverse tooth having a distal end projecting angularly from the outer sleeve surface toward the inner flange surface and a proximal end formed on the outer surface of the sleeve; and an indent formed on the outer surface of the receiving sleeve to provide space for compression of the tooth-like locking structure.

16. The concrete dowel placement device of claim 15, further comprising:

One or more gussets formed longitudinally along the outer surface of the receiving sleeve and in supporting contact with the inner surface of the flange.

17. The concrete dowel placement device of claim 15, wherein the receiving sleeve distal end is tapered to a substantially flat surface having an opening therethrough.

18. The concrete dowel placement device of claim 15, wherein the interior hollow compartment has a size and configuration permitting a dowel rod to be slidably inserted longitudinally through a central aperture comprising the flange into the receiving sleeve.

19. The concrete dowel placement device of claim 15, wherein the flange has a substantially circular shape or a substantially hexagonal shape.

20. The concrete dowel placement device of claim 15, wherein the inner surface of the flange is held in abutting contact with a flat surface of a concrete form.

21. The concrete dowel placement device of claim 15, further comprising a concrete form; and wherein the thickness of the concrete form is about equal to a distance between the inner surface of the flange and the distal end of the reverse tooth.

22. The concrete dowel placement device of claim 21, wherein the concrete form is wood.

23. The concrete dowel placement device of claim 15, wherein the device is formed of molded plastic, wood or metal.

* * * * *